US006526727B2

(12) United States Patent
McMahon et al.

(10) Patent No.: US 6,526,727 B2
(45) **Date of Patent: *Mar. 4, 2003**

(54) METHODS OF MAKING SLIDE-ZIPPERED RECLOSABLE PACKAGES ON HORIZONTAL FORM-FILL-SEAL MACHINES

(75) Inventors: Michael J. McMahon, Palatine, IL (US); Art Malin, Northbrook, IL (US); Steve Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/915,244

(22) Filed: Jul. 25, 2001

(65) Prior Publication Data

US 2001/0045083 A1 Nov. 29, 2001

Related U.S. Application Data

(62) Division of application No. 09/316,866, filed on May 21, 1999, now Pat. No. 6,138,439.

(51) Int. Cl.[7] ..... B65B 61/18

(52) U.S. Cl. ..... 53/412; 53/133.4; 53/139.2

(58) Field of Search ..... 53/412, 133.4, 53/133.9, 450, 459, 468, 570, 568, 550; 493/213, 214, 215, 927

(56) References Cited

U.S. PATENT DOCUMENTS

| | | | | |
|---|---|---|---|---|
| 3,701,192 A | * | 10/1972 | Laguerre | 53/133.4 |
| 4,241,865 A | * | 12/1980 | Ferrell | 53/133.4 |
| 4,514,962 A | * | 5/1985 | Ausnit | 53/469 |
| 4,581,006 A | * | 4/1986 | Hugues | 493/213 |
| 4,620,320 A | * | 10/1986 | Sullivan | 493/214 |
| 4,654,878 A | * | 3/1987 | Lems | 53/459 |
| 4,665,552 A | * | 5/1987 | Lems | 53/469 |
| 5,564,259 A | * | 10/1996 | Stolmeier | 53/133.4 |
| 5,664,406 A | * | 9/1997 | Smith | 53/459 |
| 5,682,730 A | * | 11/1997 | Dobreski | 53/469 |
| 5,956,924 A | * | 9/1999 | Thieman | 53/42 |

FOREIGN PATENT DOCUMENTS

| | | | | |
|---|---|---|---|---|
| EP | 0 873 856 A2 | | 10/1998 | |
| EP | 0 873 856 A3 | | 10/2001 | |
| FR | 1 525 718 | | 9/1968 | |
| GB | 2085519 | * | 4/1982 | 53/133.4 |
| WO | WO 99/24325 | | 5/1999 | |

* cited by examiner

*Primary Examiner*—John Sipos
(74) *Attorney, Agent, or Firm*—Pitney, Hardin, Kipp & Szuch LLP

(57) ABSTRACT

Methods of making slide-zippered reclosable packages are provided. In one embodiment, a pair of opposing film extensions are provided on each package between which a zipper and slider are attached. In another embodiment, sliders are inserted on to zippered packages output from a form-fill-seal machine or the like. In yet another embodiment, during package formation a reclosable zipper is sealed to each package and then a slider is inserted on to the zipper. In yet another embodiment, during package formation a reclosable zipper is sealed to each package and a slider is inserted on to each zipper, either before or after zipper sealing.

1 Claim, 12 Drawing Sheets

METHODS OF MAKING SLIDE-ZIPPERED RECLOSABLE PACKAGES ON HORIZONTAL FORM-FILL-SEAL MACHINES

CROSS REFERENCE TO RELATED APPLICATIONS

This is a division of U.S. patent application Ser. No. 09/316,866 filed on May 21, 1999 now U.S. Pat. No. 6,138,439.

BACKGROUND OF THE INVENTION

1. Field of the Invention

The present invention relates to the field of reclosable packaging. More particularly, the present invention relates to methods of making reclosable packages having slide zippers on horizontal form-fill-seal (HFFS) machines.

2. Description of the Prior Art

Methods of making reclosable packages on various types of HFFS machines are well-known in the reclosable packaging art, such as that disclosed in U.S. Pat. No. 4,876,842. Slide zippers, i.e., plastic zippers opened and closed by a slider, are likewise well-known in the reclosable packaging art. Examples of several types of slide zippers can be found in U.S. Pat. Nos. 5,007,143, 5,008,971, 5,131,121 and 5,664,299.

The reclosable packaging art, however, is virtually, if not totally, silent as it relates to the manufacture of slide-zippered packages on HFFS machines. Because of the facility which is provided by slide zippers to consumers of reclosable packages and because of the large volume of reclosable packages made on HFFS machines today, it is highly desirable and advantageous to combine the two technologies so that slide-zippered reclosable packages can be made on HFFS machines.

SUMMARY OF THE INVENTION

Accordingly, the object of the present invention is to provide methods of making slide-zippered reclosable packages on HFFS machines.

According to a first embodiment of the present invention, a chain of packages is formed, filled and sealed on an HFFS machine or the like. A pair of opposing film extensions are provided on each package. As the chain of packages is indexed forwardly, a reclosable zipper is inserted between the film extensions of the leading package and sealed thereto. A slider is then inserted on to the reclosable zipper of the leading package and the completed leading package is cut from the chain.

According to a second embodiment of the present invention, packages having reclosable zippers are output from an HFFS machine or the like, either individually or in a chain. A slider is then inserted on to the zipper of each package in turn.

According to a third embodiment of the present invention, packages are formed, filled and sealed on an HFFS machine or the like. During package formation, a reclosable zipper is sealed to each package and then a slider is inserted on to the zipper.

According to a fourth embodiment of the present invention, packages are formed, filled and sealed on a horizontal form-vertical fill-seal (HVFS) machine or the like. During package formation, a reclosable zipper is sealed to each package and a slider is inserted on to each zipper, either before or after zipper sealing.

The present invention will now be described in detail, with frequent reference being made to the drawings identified below in which the same numerals represent the same elements.

DETAILED DESCRIPTION OF THE PREFERRED EMBODIMENT

Figure 1:
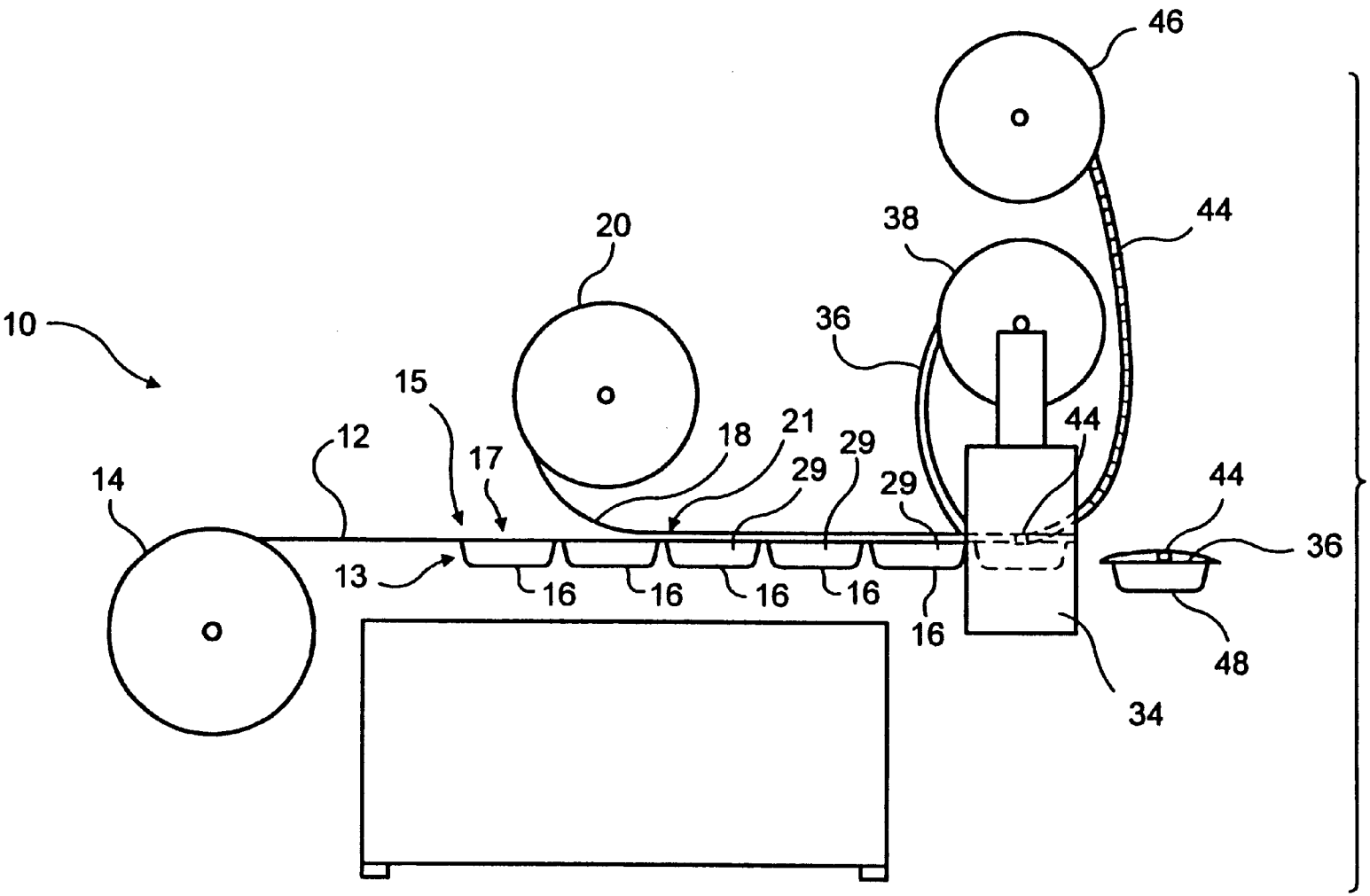
FIG. 1 shows packages being made on an HFFS machine in accordance with a first embodiment of the present invention.
Figure 2:
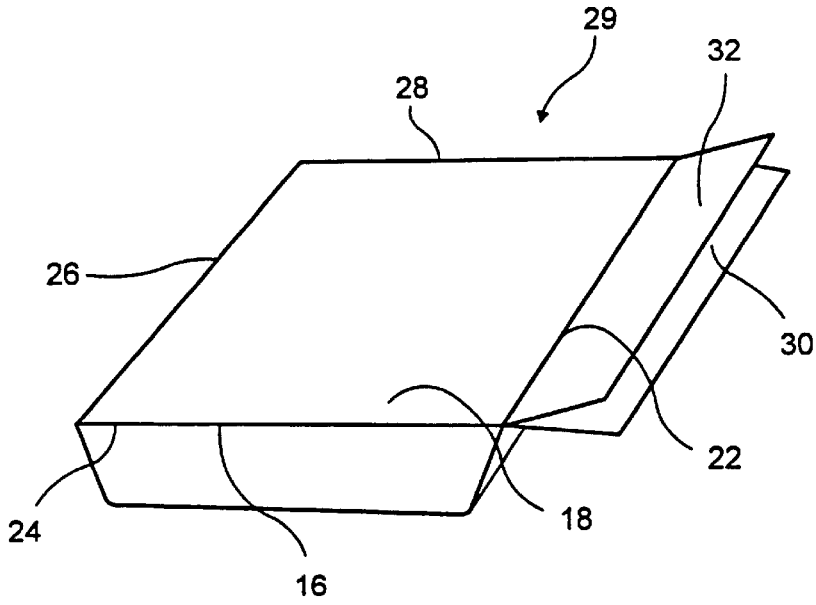
FIG. 2 is a perspective view of a package made on the HFFS machine of FIG. 1 prior to attaching the zipper.

In accordance with a first embodiment of the present invention, FIG. 1 shows how slide-zippered packages can be made on a typical thermoform HFFS machine 10. Forming film 12 is indexed off a coil 14 of the same in a package forming direction. Downstream of the forming film coil 14 at a forming station 15 the forming film 12 is thermoformed, using techniques well-known to those of ordinary skill in the reclosable packaging art, into a chain 13 of advancing box-like bottom portions or trays 16 of what will ultimately be completed packages. Product may then be loaded into the bottom portions 16 at a loading station 17 if desired. After optional product loading, top film 18 is indexed off a coil 20 of the same in the package forming direction, laid over the advancing bottom portions 16 and perimeterly sealed thereto at four locations 22, 24, 26, 28 at a sealing station 21 to form a sealed package 29, as shown in FIG. 2. The seal at the package opening 22 takes the form of a peel seal so that the consumer can easily gain access to the contents of the package.

As shown in FIG. 2, which is a perspective view of a sealed package 29 formed on the thermoform HFFS machine of FIG. 1 prior to zipper and slider insertion, the bottom portion 16 and top film 18 are each provided with film extensions 30, 32 which extend beyond the peel seal 22 on one side of the package 29. The film extensions 30, 32 are not sealed to each other and may readily be spread apart from each other.

Figure 3:
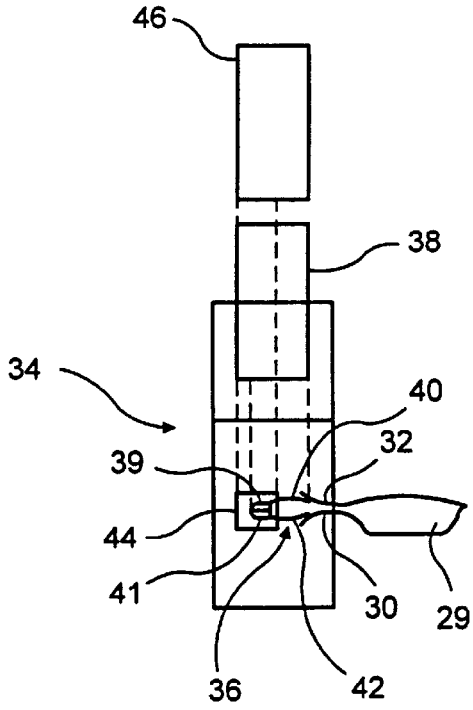
FIG. 3 is a cross-sectional view of the HFFS machine of FIG. 1 at the slider insertion point.

After the top film 18 is sealed to the bottom portion 16 at the sealing station 21, the package chain 13 enters a zipper and slider insertion and attaching station 34. At this station 34 the film extensions 30, 32 of the leading package are spread apart from each other and interlocked reclosable zipper 36 supplied from a coil 38 of the same is fed between the film extensions 30, 32, as shown in FIG. 3, which is a cross-sectional view of the package chain and zipper and slider insertion and attaching station 34. The zipper is comprised of two interlocking closure elements 39, 41 and flanges 40, 42 extending therefrom which are sealed to the film extensions 30, 32, such as by a pair of seal bars (not shown). After the zipper 36 is thus sealed to the film extensions of the leading package, the zipper 36 is stomped at each end of the package by a stomping apparatus (not shown) to provide end stops for the slider and to ensure that the ends of the zipper 36 do not come apart during use.

A slider 44 is then removed from a coil 46 thereof and inserted on to the zipper 36 by a slider insertion apparatus (not shown). The slider and zipper are designed such that the slider will open the zipper as the slider is moved along the zipper in an opening direction towards an opening end of the zipper and close the zipper as the slider is moved along the zipper in a closing direction towards a closing end of the zipper. It is preferable during slider insertion that the slider be inserted at the closing end of the zipper since the zipper is initially interlocked. The slider will thus be positioned for normal functioning. If the slider is inserted at a location other than at the closing end, it will be necessary to actuate the slider by moving it to the closing end, after which the slider will be in position for normal functioning. Such actuation may be done on the HFFS machine, or it may be done by the initial package user.

After slider insertion, the leading package is cross-cut from the remainder of the chain 13 by any one of many commonly known cutting apparatuses (not shown) to remove a completed package 48 having a slide zipper.

Figure 4:
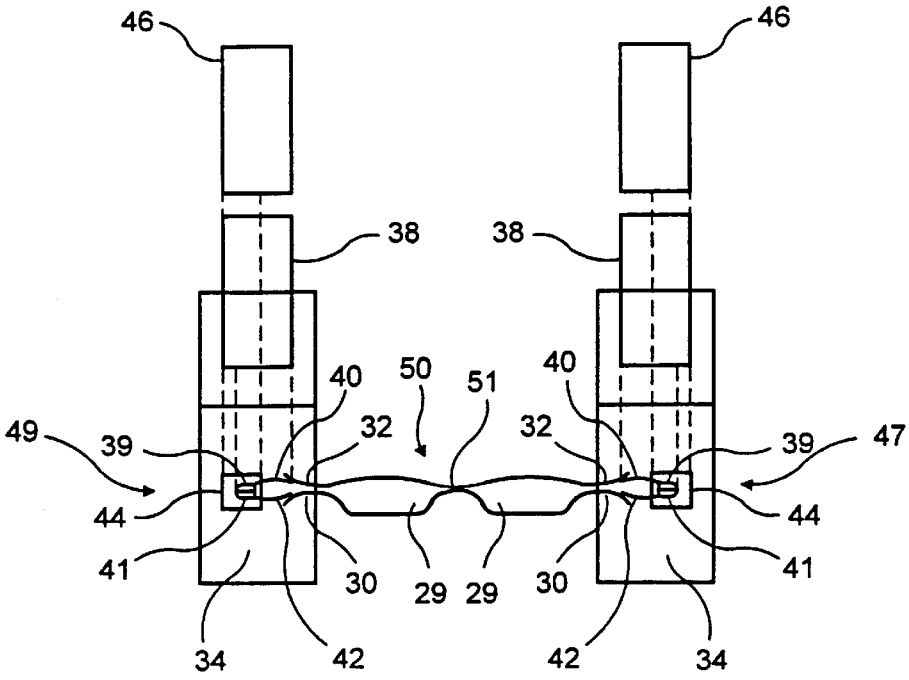
FIG. 4 is a cross-sectional view of a first variation of the HFFS machine of FIG. 1.

In practice, the package chain 13 may be a single chain as shown in FIG. 3, or, alternatively, may be a multiple chain, such as the double chain 50 shown in cross-section in FIG. 4. In the case of a double chain, where two packages are joined side by side, the process of making the packages is virtually identical to that described above, except that the zippers and sliders are attached to the opposite sides 47, 49 of the package chain simultaneously, as shown in FIG. 4, thus requiring two zipper and slider insertion and attaching stations 34. Additionally, a second cut is needed in the machine direction along the central axis 51 of the chain to remove the side-by-side packages from one another.

The foregoing embodiment of the present invention is not limited to practice on thermoform HFFS machines, but may be practiced on any type of package making machine where the packages are formed with film extensions 30, 32 of the type discussed above.

Figure 5:
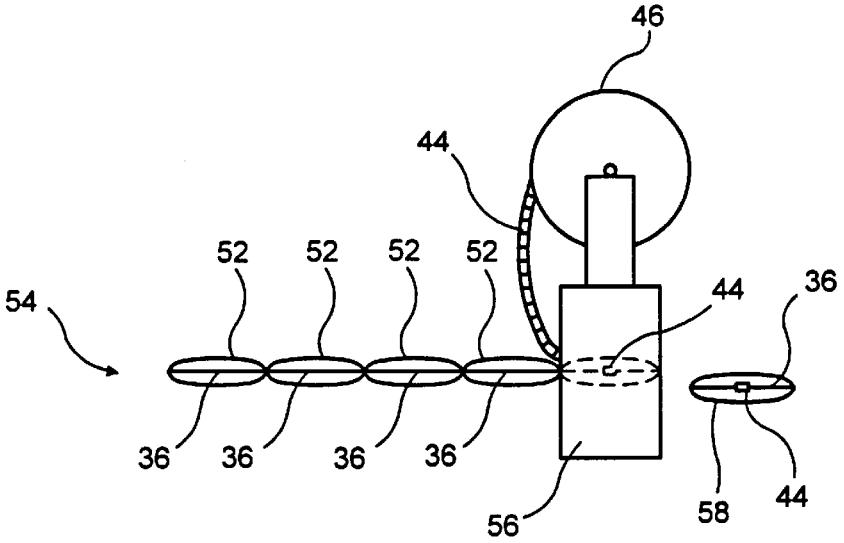
FIG. 5 shows sliders being inserted on a chain of packages in accordance with a second embodiment of the present invention.
Figure 6:
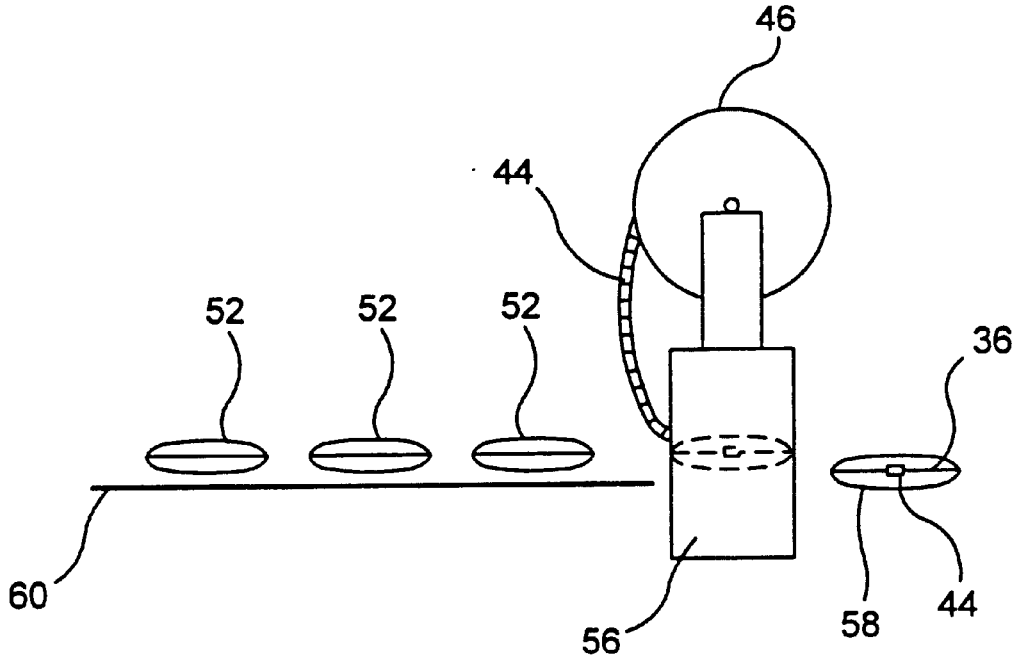
FIG. 6 shows sliders being inserted on to individual packages in accordance with a variation of the second embodiment of the present invention.

FIGS. 5 and 6 depict a second embodiment of the present invention. Zippered packages 52, either in a chain 54 as shown in FIG. 5 or individually as shown in FIG. 6, are output from an HFFS machine (not shown), or any other type of bag making machine. In the case of FIG. 5, the package chain 54 is indexed into a slider insertion station 56. At the slider insertion station 56 or at an earlier station, the ends of the zipper 36 on the leading package in the chain 54 are stomped as discussed above. Then, a slider 44 is removed from the slider coil 46 and inserted on to the zipper 36. Finally, a completed package 58 have a slide zipper is cross-cut from the chain by a cutting apparatus (not shown).

In the case of FIG. 6, the packages 52 are individual and not chained together. The individual packages 52 are transported one by one into the slider insertion station 56 by a conveyor belt 60 or the like, where the ends of the zipper 36 on the leading package are stomped (unless the stomping was done during package formation) and a slider 44 is removed from the slider coil 46 and inserted on to the zipper 36 to provide a completed slide-zippered package 58.

Figure 7A:
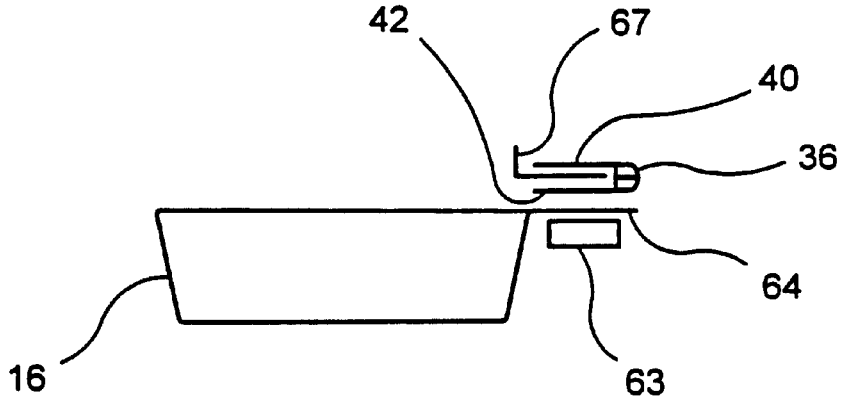
FIG. 7*a* is a cross-sectional view of the HFFS machine of FIG. 7 at the first zipper sealing station.
Figure 7:
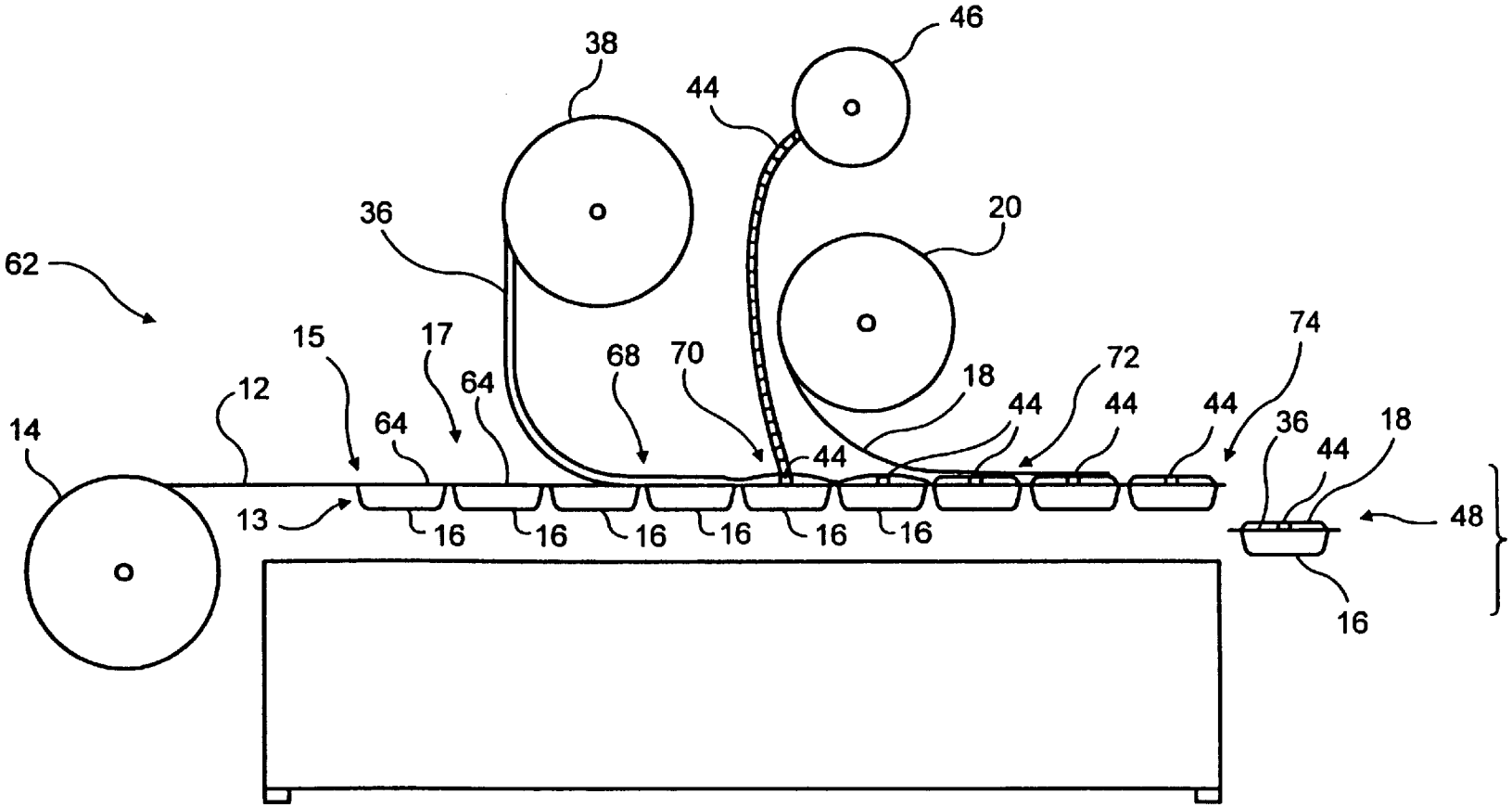
FIG. 7 shows packages being made on an HFFS machine in accordance with a third embodiment of the present invention.
Figure 8:
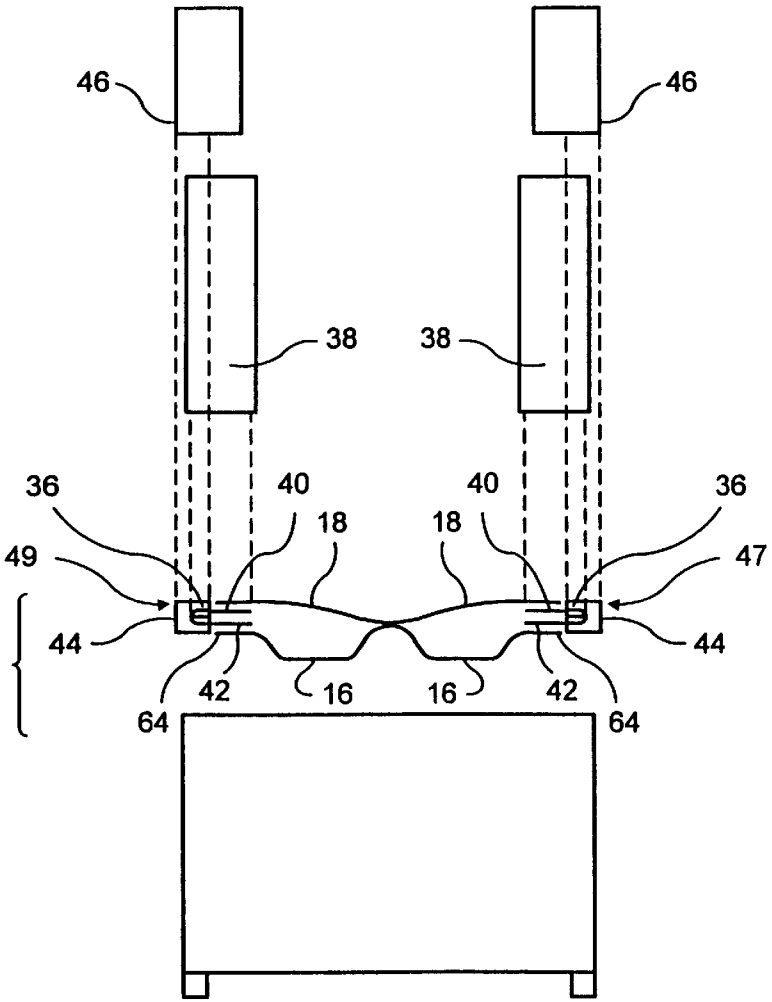
FIG. 8 is a cross-sectional view of the HFFS machine of FIG. 7.

In accordance with a third embodiment of the present invention, FIG. 7 shows a thermoform HFFS machine 62 configured to make slide-zippered packages. As in FIG. 1, the forming film 12 is indexed off a coil 14 of the same. Downstream of the forming film coil 14 at a forming station 15 the forming film 12 is thermoformed into a chain 13 of box-like bottom portions or trays 16 of what will ultimately be completed packages. Product may then be loaded into the bottom portions 16 at the loading station 17 if desired. Each bottom portion 16 is provided with a lip 64 on one side thereof, as shown in FIG. 8, which is a cross-sectional view of the chain 13. After optional product loading, the reclosable zipper 36 is indexed off a coil 38 of the same and laid over the lips 64 of the bottom portions 16. The lower zipper flange 42 is then sealed to the lips 64 by a sealing mechanism, such as a heater bar 63, at a sealing station 68. The heater bar 63 is positioned below the lips 64, as shown in FIG. 7*a*, which is a cross-sectional view of zipper attachment to the package lips. Also shown in FIG. 7*a* is an insulating and guide plate 67 positioned between the zipper flanges. The insulating and guide plate 67 provides a surface for the heater bar to react against and removes any danger of sealing through the zipper flanges, thereby eliminating the need for accurate heat control. The insulating and guide plate 67 also serves to guide and position the zipper onto the package lips to ensure accurate sealing.

Figure 9:
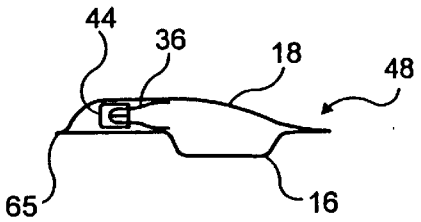
FIG. 9 is a cross-sectional view of a package made on the HFFS machine of FIG. 7.

A slider 44 is then removed from the slider coil 46 and inserted on to the zipper 36 of the instant bottom portion 16 at an insertion station 70. After slider insertion, the ends of the zipper are stomped. Alternatively, the zipper ends could have been stomped together earlier, either on the machine or pre-stomped prior to winding on the supply coil, and the zipper indexed to the bottom portion. The top film 18 is then indexed off the top film coil 20, laid over the formed bottoms 16 and the attached zipper 36 and sealed to the formed bottoms 16 and the upper flange 40 of the zipper 36 around the perimeter of the package at a second sealing station 72. As discussed above, the seal at the mouth of the package may take the form of a peel seal to provide easy access to the contents of the package. Optionally, the top film 18, if it is long enough, may be heat tacked to the bottom portion 16 over the zipper 36 to provide a tamper evident seal 65, as shown in FIG. 9. In the final step, the completed packages 48 are cross-cut from the chain at a cutting station 74. If a double chain is used, as shown in FIG. 8, then the side-by-side packages must also be cut from each other in the machine direction.

Figure 11:
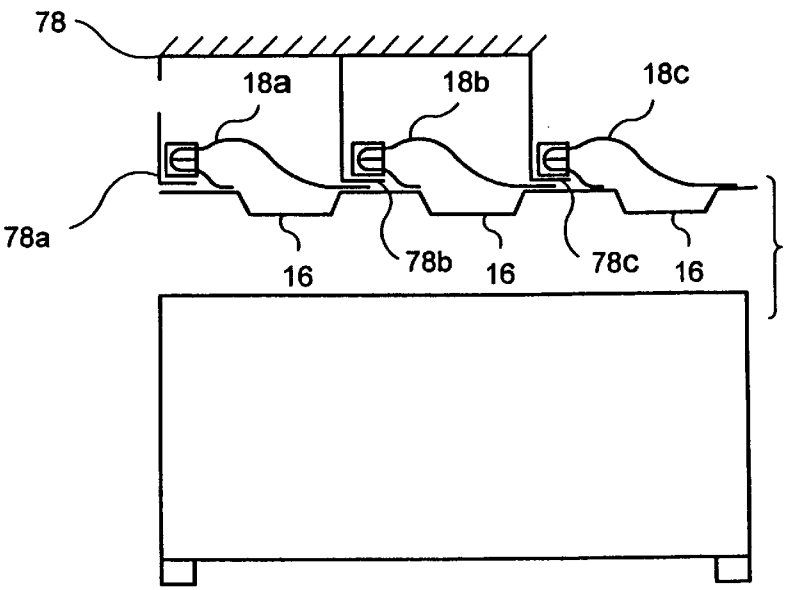
FIG. 11 is a cross-sectional view of packages being made on the HFFS machine of FIG. 10.
Figure 10:
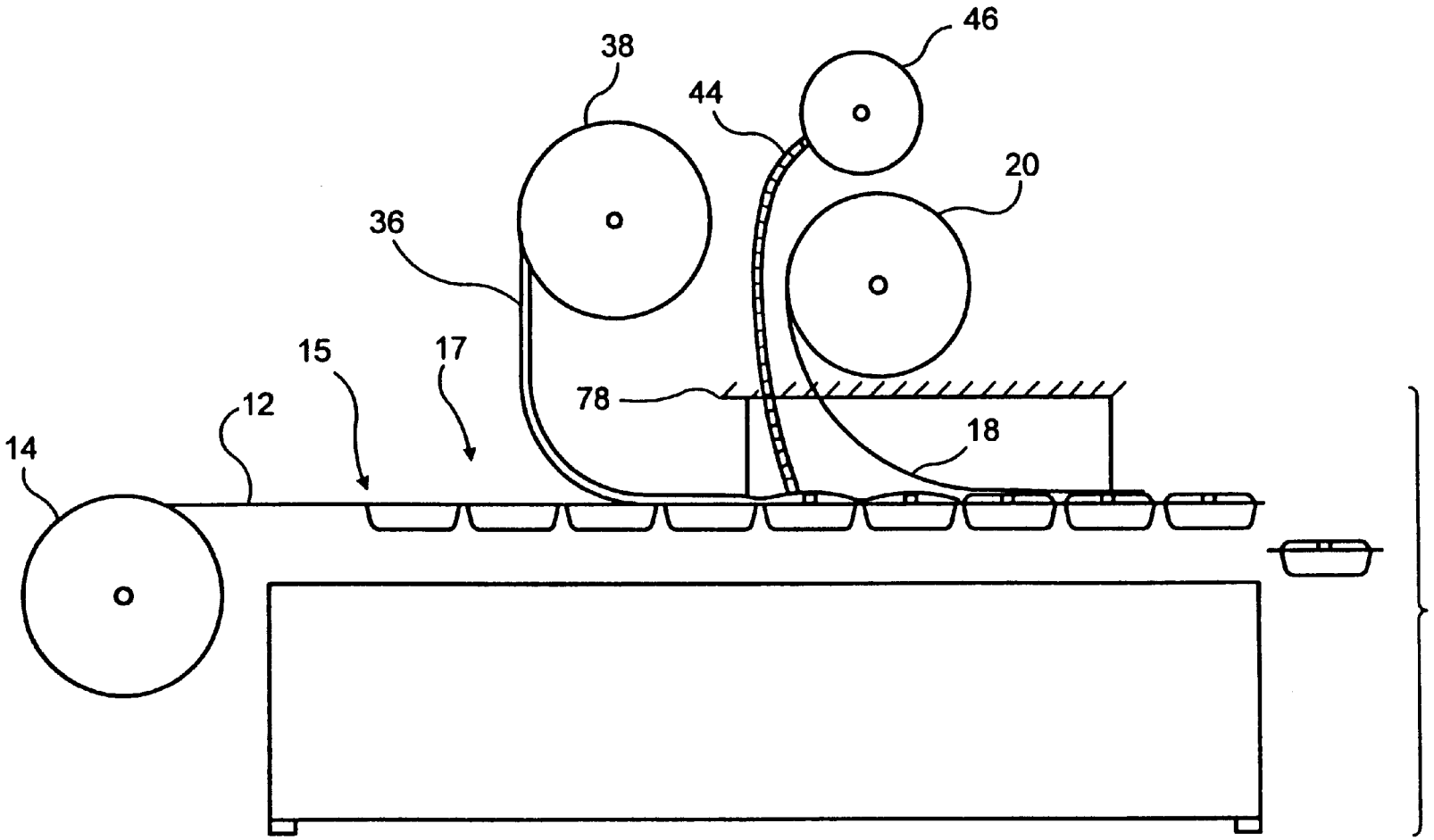
FIG. 10 shows packages being made on an HFFS machine in accordance with a variation of the third embodiment of the present invention.

When making packages using multiple package chains, it is not necessary that the zippers and sliders be applied to opposite sides 47, 49 of the package chain, as shown in FIGS. 4 and 8. Rather, it is also possible to apply the zippers and sliders to the same sides of the packages. For example, a triple package chain is shown in FIGS. 10 and 11. In this case the top film 18 is pre-perforated so that it can be split into three sections and laid over each of the bottom portions 16. This splitting is achieved by a separator assembly 78 having three L-shaped separator plates 78*a*, 78*b*, 78*c*. As the top film 18 is indexed off its roll 20, the vertical portions of the separator plates 78*a*, 78*b*, 78*c* split the pre-perforated top film 18 into three portions 18*a*, 18*b*, 18*c* and guide the three top film portions as they are laid over their corresponding bottom portions 16. Additionally, the horizontal portions of the separator plates interact with the sealing mechanism to ensure that there is no seal through, eliminating the need for accurate heat control.

Figure 12:
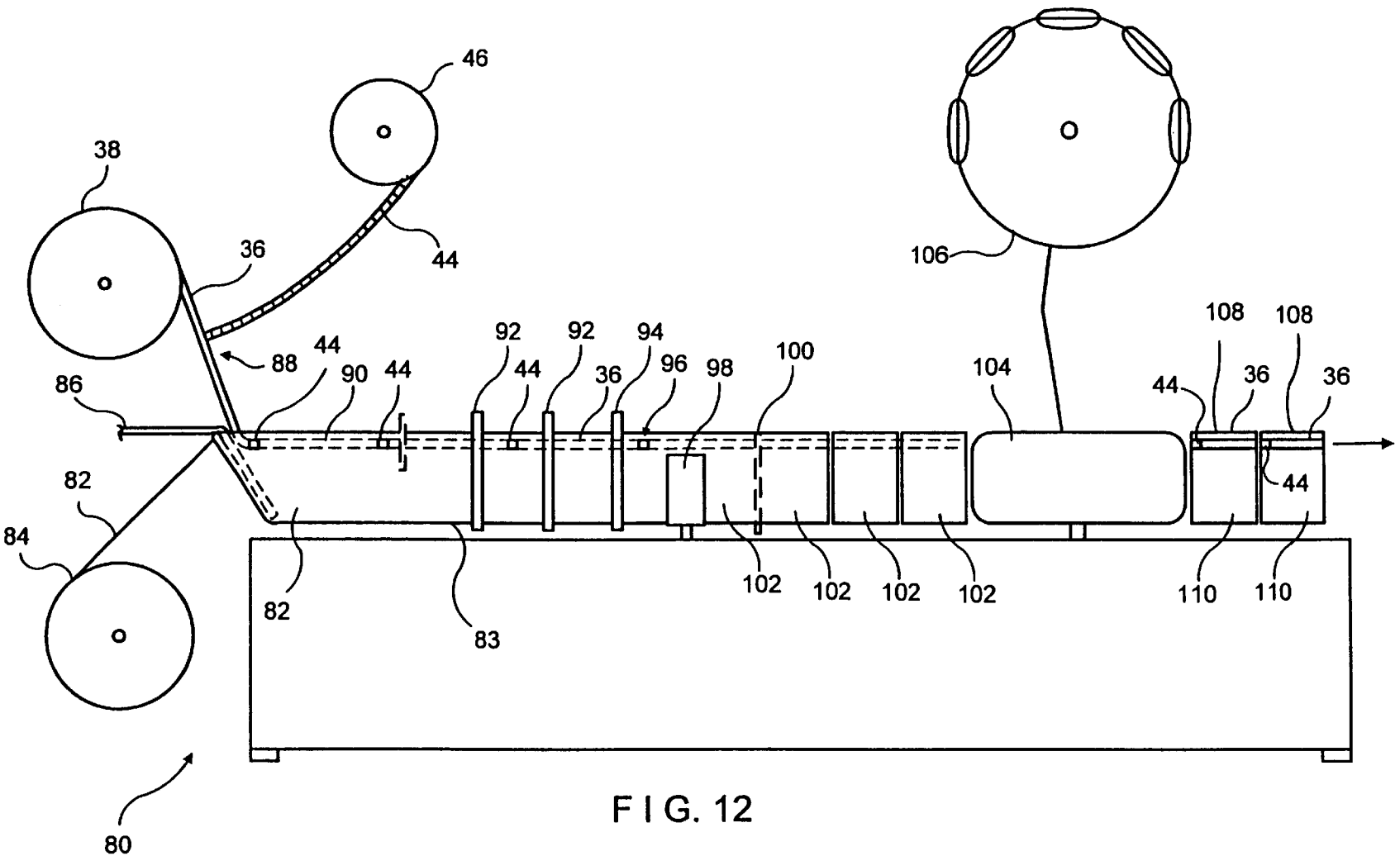
FIG. 12 shows packages being made on an HFVS machine in accordance with a fourth embodiment of the present invention.

As indicated above, the present invention is not limited to thermoform HFFS machines, but may be practiced on any type of HFFS machine and on any type of bag making machine for that matter. FIG. 12 shows how slide-zippered packages can be made on a horizontal form-vertical fill-seal machine (HFVS) 80 in accordance with a fourth embodiment of the present invention.

Package film 82 is paid off a roll 84 of the same. Downstream a pull roller 98 is provided for driving the film 82 through the machine. A folder plow 86 positioned downstream of the film roll 84 folds the package film 82 about a bottom crease 83 to form opposing package walls 116, 118. Interlocked reclosable zipper 36 is then paid off a roll 38 of the same and fed between the advancing package walls. Sliders 44 are inserted on to the reclosable zipper 36 prior to the folder plow 86 at package width intervals at what will be the closing end of the zipper by a slider insertion mechanism at the slider insertion station 88. The sliders 44 are supplied from the slider coil 46.

At a first sealing station 90, the zipper flanges 40, 42 are sealed to the opposing package walls. Then at stomping stations 92, the ends of the zipper 36 for a given package are stomped. At a second sealing station 94, the folded film and zipper are cross-sealed to form discrete packages.

Because the zippers are closed, it is necessary to open the zippers in order to fill the packages. This is achieved at a slider opening station 96, where the slider is held in position as the zipper and film are advanced when the pull rollers 98 are activated. As the zipper moves through the slider, it is opened. Alternatively, the slider itself may be moved. Then, at a cutting station 100 the individual packages 102 are cut from one another. The separated packages 102 are then taken to the filling station 104 where they are filled. Filling may occur by means of a filling turret 106 or the packages may be filled in-line, both of which techniques are well-known to those of ordinary skill in the art. After a package is filled, the slider 44 is moved backed to the closing end of the zipper. Finally, a tamper evident 108 seal may optionally be provided above the zipper 36. Completed slide-zippered packages 110 are then output from the machine.

Figure 13:
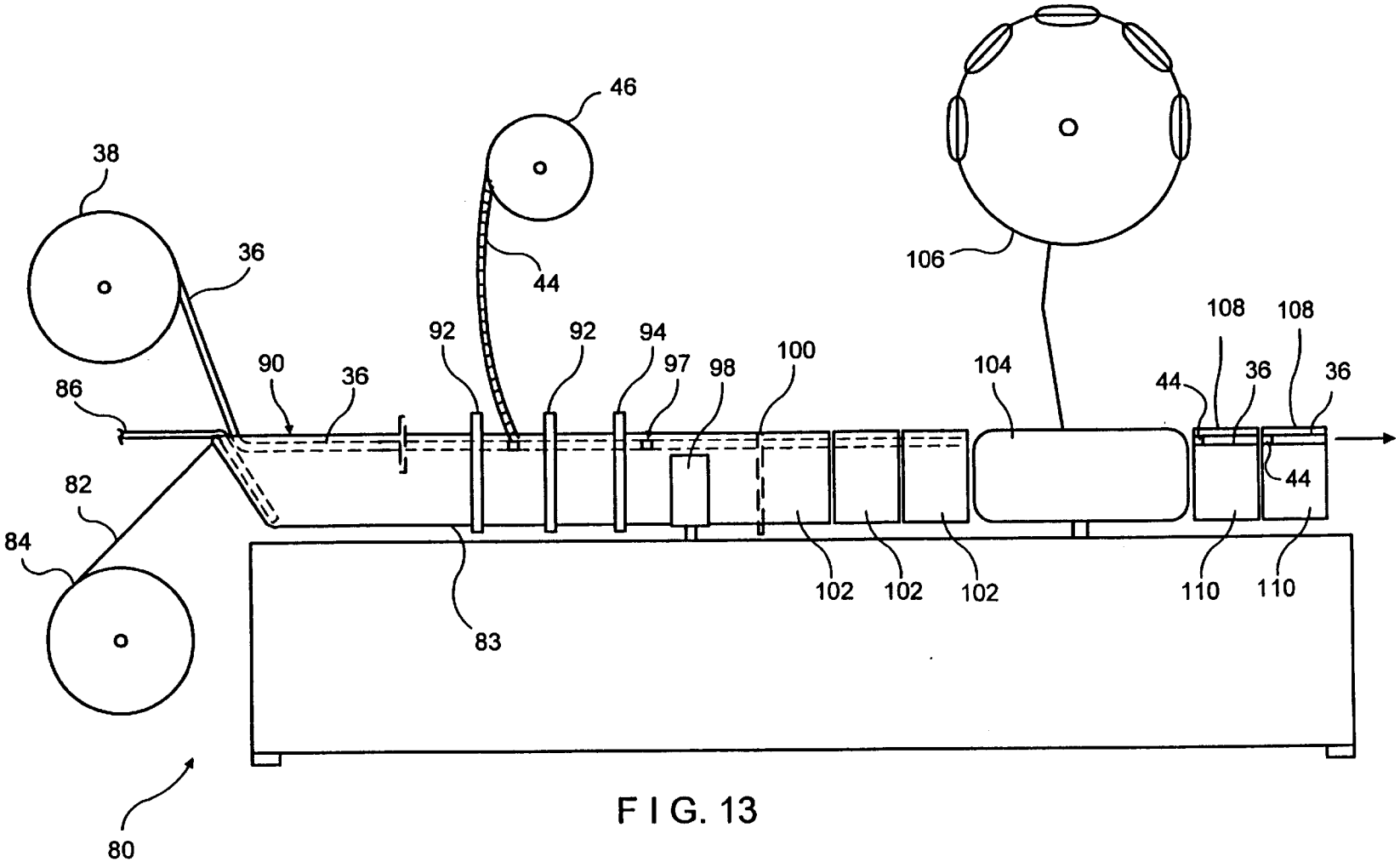
FIG. 13 shows packages being made on an HFVS machine in accordance with a first variation of the fourth embodiment of the present invention.

A first variation of the fourth embodiment is shown in FIG. 13. As is clear from FIG. 13, the sliders are attached downstream of the folder plow 86, rather than upstream of the folder plow 86. Additionally, the sliders 44 are attached to the zippers 36 at their opening ends, rather than at their closing ends as above. Thus, in order to open the zippers for package filling the zippers must be forced open from the outside of the packages, rather than by using the sliders. This opening action is carried out at an opening station 97 by a suitable mechanism provided for the specific zipper construction. After filling at the filling station 104, the slider is moved to the closing end of the zipper.

Figure 14:
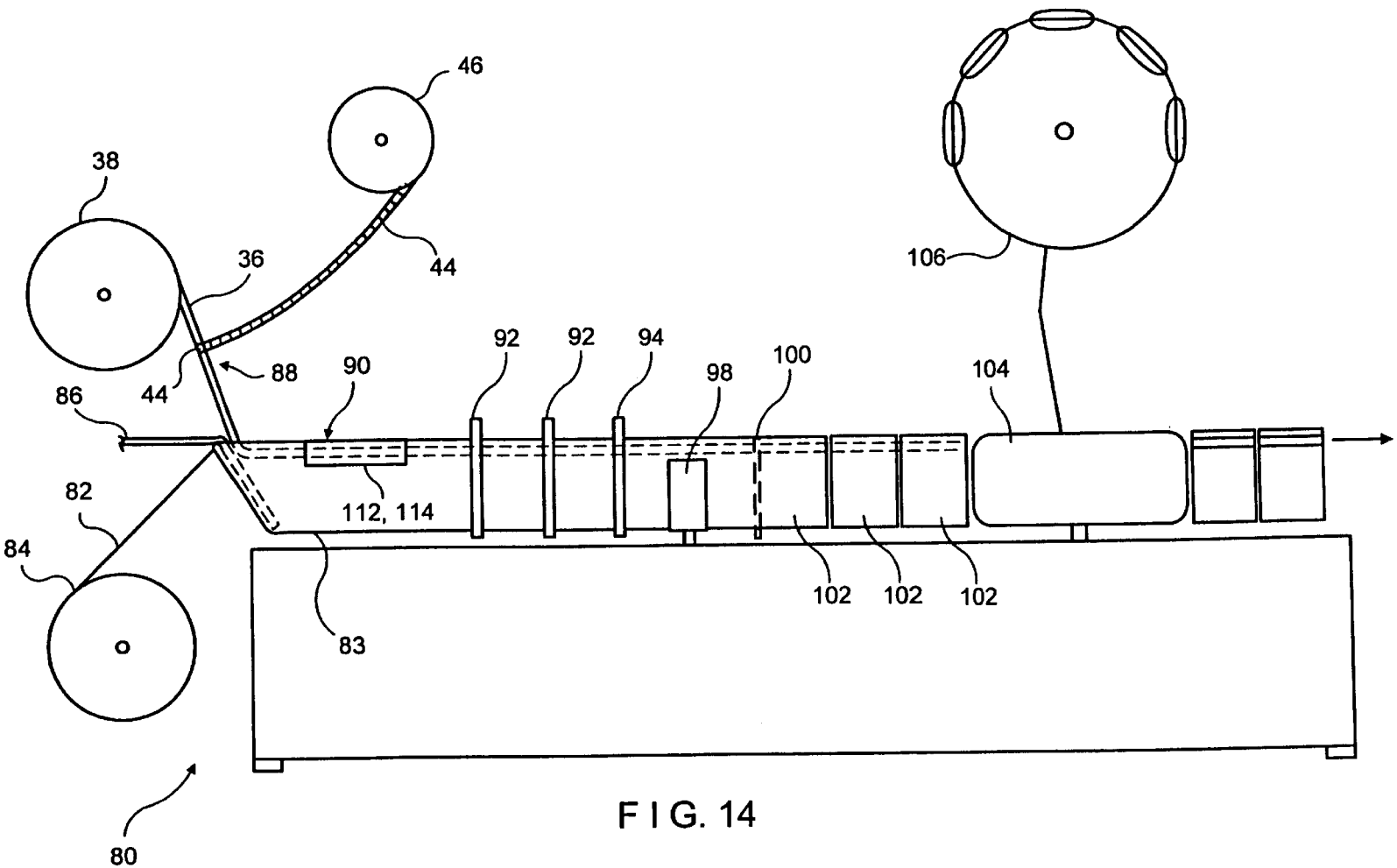
FIG. 14 shows packages being made on an HFVS machine in accordance with a second variation of the fourth embodiment of the present invention.

A second variation of the fourth embodiment of the present invention is shown in FIG. 14. Under certain circumstances it may be desirable to eliminate the step of opening the zipper for filling. This can be done by sealing one zipper flange to one side of the folded film at the first sealing station 90 prior to filling, as shown in FIG. 15, rather than sealing both flanges to the film as done previously.

Figure 15:
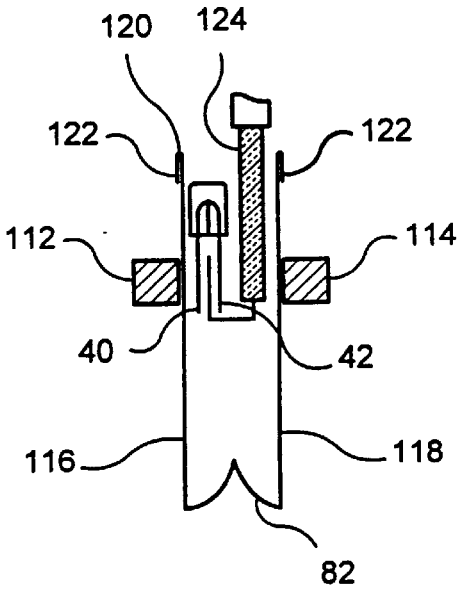
FIG. 15 is a cross-sectional view of reclosable zipper being sealed to one package side in the HFVS machine of FIG. 14.
Figure 16:
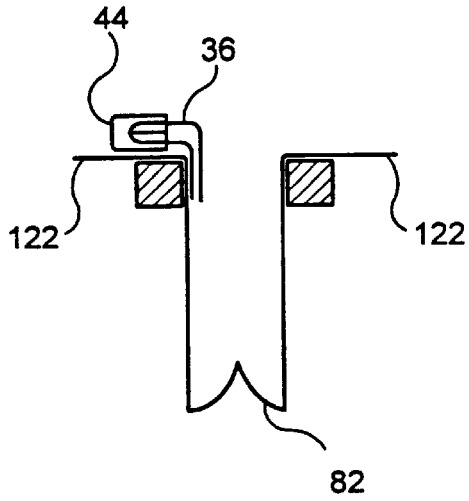
FIG. 16 is a cross-sectional view of a package prior to being filled on the HFVS machine of FIG. 14.
Figure 17:
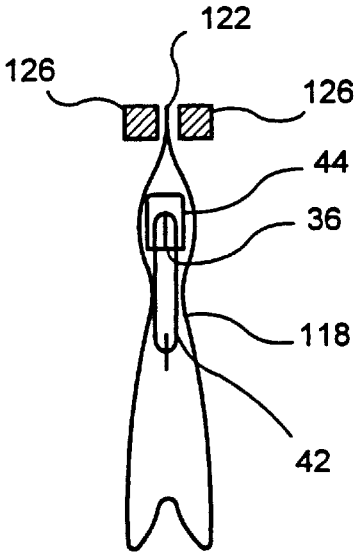
FIG. 17 is a cross-sectional view of a tamper evident sealed being placed on a package made on the HFVS machine of FIG. 14.

As shown in FIG. 15, one flange 40 of the zipper is sealed to one wall 116 of the folded film 82 a distance below the top 120. The film 82 protrudes above the zipper to form a pair of opposing ears 122. To ensure that the zipper flanges 40, 42 do not seal to each other or the other side of the package at the first sealing station 90, a J-shaped insulator plate 124 is inserted between the zipper flanges 40, 42 and between the unsealed zipper flange 42 and the other package wall 118, as shown in FIG. 15. In addition, one of the seal bars 112 is kept hot and the other 114 is deactivated. Then, at the second sealing station 94, the packages are cross-sealed from the bottom of the film 92 up to but not including the zipper. When it comes time to fill the bag at the filling station 104, the zipper is bent to one side, as shown in FIG. 16. In this manner, filing may proceed unobstructed, and there is no danger of contaminating the zipper. After filling, the unsealed zipper flange 42 is sealed to the other side of the package and the ears 122 are sealed to each other by a pair of seal bars 126 with a perforation seal and a peel seal above the zipper 36, as shown in FIG. 17. At the same time the ends of the zipper are cross-sealed together and end stops for the slider are created. The above indicated zipper cross-seals extend below the zipper flanges into the package side seals, but not above and beyond the zipper profiles.

Figure 19:
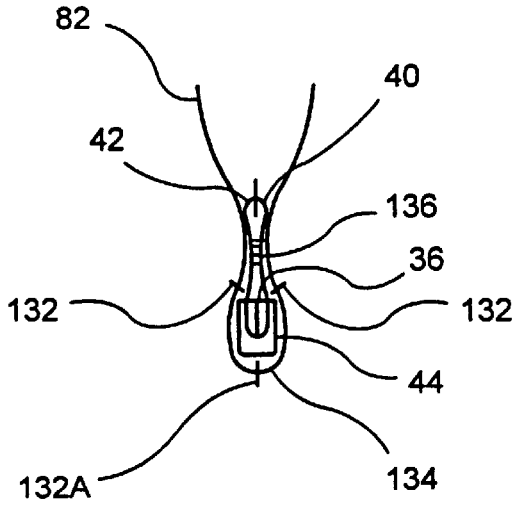
FIG. 19 is a cross-sectional view of a package being formed on the HFVS machine of FIG. 18.
Figure 18:
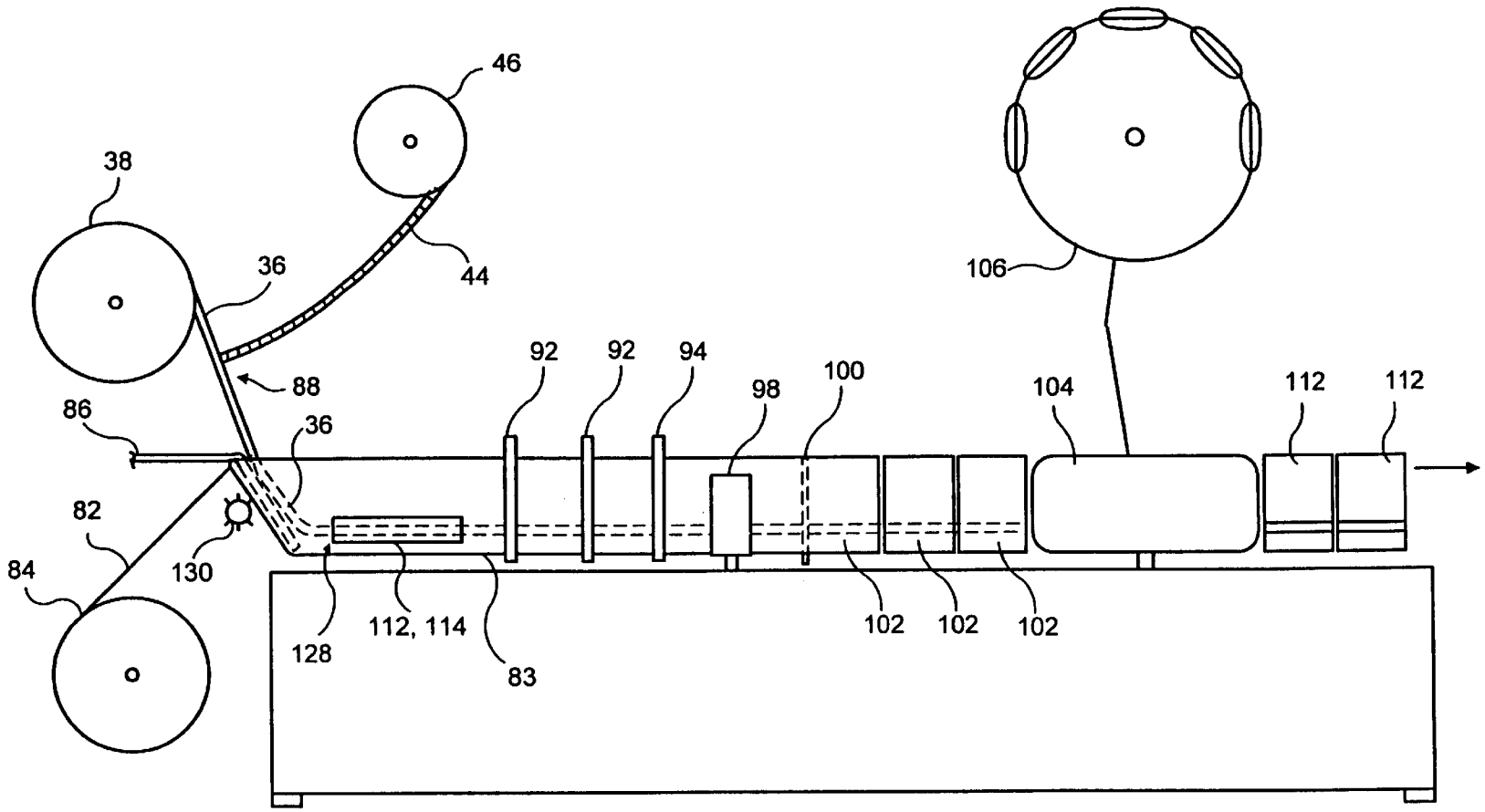
FIG. 18 shows packages being made on an HFVS machine in accordance with a third variation of the fourth embodiment of the present invention.

A third variation of the fourth embodiment of the present invention is shown in FIG. 18. In this variation, the zipper 36 and slider 44 are attached to the bottom 128 of the package, rather than at the top 120. As the film 82 is fed over the folder plow 86, a perforator 130 perforates the film 82 below the slider 44 to form a pair of perforations 132 (alternatively, a single perforation 132*a* may be provided). The zipper is then sealed to the bottom of the package by sealing the zipper flanges to the film beyond the perforation lines, as shown in FIG. 19. A peel seal 136 may be provided between the zipper flanges in order to maintain the integrity of the packages.

The packages are completed as discussed above, except that they are filled from the opposing end to which the zipper has been attached. Further, if a bottom gusset is required a V shaped film can be introduced between the package walls 116 and 118 and sealed into place. During use, the packages are inverted so that the zipper and slider are at the top and the perforated portion 134 is torn away from the package to gain access to the slider.

Thus, in the foregoing manner the object of the present invention is achieved. Modifications to the above would be obvious to those of ordinary skill in the art, but would not bring the invention so modified beyond the scope of the appended claims.

We claim:

1. A method of making reclosable packages, said method comprising the steps of:

feeding a supply of package film in a package forming direction;

folding said package film about a bottom crease to form opposing package walls, said opposing package walls advancing in said package forming direction;

feeding a supply of interlocked reclosable zipper between said opposing package walls;

sealing said reclosable zipper to said opposing package walls;

providing a supply of sliders, each of said sliders being insertable on to said reclosable zipper and adapted to open and close said reclosable zipper as said slider is moved along said reclosable zipper in opening and closing directions, respectively;

removing sliders from said slider supply and inserting said sliders on to said reclosable zipper while said reclosable zipper remains fully interlocked, wherein said step of inserting is performed after said step of feeding said supply of interlocked reclosable zipper;

cross-sealing said folded film at package-width intervals to form a chain of packages, each of said packages having a reclosable zipper and a slider;

opening the reclosable zipper of each package by from the outside of said package with an opening mechanism thereby forming a mouth on an upper end of each package;

filling each package through said mouth; and closing the reclosable zipper of each package.

* * * * *

UNITED STATES PATENT AND TRADEMARK OFFICE

CERTIFICATE OF CORRECTION

PATENT NO. : 6,526,727 B2
DATED : March 4, 2003
INVENTOR(S) : McMahon et al.

It is certified that error appears in the above-identified patent and that said Letters Patent is hereby corrected as shown below:

Title page,
Item [62], Related U.S. Application Data, amend as follows:

-- [62] Division of application serial no. 09/631,179 filed August 2, 2000 which is a division of application No. 09/316,866, filed on May 21, 1999, now Pat. No. 6,138,439. --

Signed and Sealed this

Twenty-first Day of September, 2004

JON W. DUDAS
*Director of the United States Patent and Trademark Office*